US010413132B2

(12) United States Patent
Cooper

(10) Patent No.: US 10,413,132 B2
(45) Date of Patent: Sep. 17, 2019

(54) BATHTUB INSERT ASSEMBLY

(71) Applicant: Barbara Cooper, Lincoln City, OR (US)

(72) Inventor: Barbara Cooper, Lincoln City, OR (US)

( * ) Notice: Subject to any disclaimer, the term of this patent is extended or adjusted under 35 U.S.C. 154(b) by 24 days.

(21) Appl. No.: 15/724,870

(22) Filed: Oct. 4, 2017

(65) Prior Publication Data

US 2019/0099044 A1 Apr. 4, 2019

(51) Int. Cl.
*A47K 3/12* (2006.01)
*A47K 3/00* (2006.01)

(52) U.S. Cl.
CPC ..... *A47K 3/125* (2013.01); *A47K 3/002* (2013.01); *A47K 3/003* (2013.01); *A47K 3/122* (2013.01)

(58) Field of Classification Search
CPC ..... A47K 3/125; A47K 3/002; A47K 3/003; A47K 3/122
USPC ..... 4/621, 580–583
See application file for complete search history.

(56) References Cited

U.S. PATENT DOCUMENTS 1,577,608 A * 3/1926 Brewer ..... A47K 3/002 248/206.3
3,719,960 A * 3/1973 Russell ..... A47K 3/006 4/556
4,365,367 A * 12/1982 Houle ..... A47K 3/006 4/538
4,956,882 A 9/1990 Cohn, III
D355,245 S * 2/1995 Sills ..... D23/279
6,085,367 A * 7/2000 Guiste ..... A47K 3/002 4/546
6,101,642 A * 8/2000 Auten ..... A47K 3/002 4/546
6,473,915 B1 * 11/2002 Davis ..... A47K 3/006 4/555
6,804,842 B1 10/2004 Johnson
7,152,256 B1 12/2006 Roberts
7,237,276 B2 7/2007 Longman
8,448,269 B2 5/2013 Libit et al.
D697,183 S 1/2014 Sital et al.
9,003,576 B2 * 4/2015 Rubin ..... A47K 17/022 4/559
9,375,115 B2 6/2016 Stafford et al.
D799,303 S * 10/2017 Boeltl ..... D8/315
2005/0102746 A1 5/2005 Wright et al.

FOREIGN PATENT DOCUMENTS

WO WO2012088255 6/2012

* cited by examiner

*Primary Examiner* — Huyen D Le

(57) ABSTRACT

A bathtub insert assembly for facilitating safe bathing includes a shell, which has a top that is open. A lower section of the shell is substantially complementary to a width of a bathtub. An interior surface of the shell is resilient and is configured to absorb an impact imparted by a user to prevent injury. A first plate and a second plate are coupled to a first and second ends of the shell, respectively. The first plate is configured to seat the user. The second plate is configured to support the user's feet. A pair of armrests is coupled to the shell between the first plate and the top of the shell. At least one rail is coupled to the interior surface and is configured to position items, such as soap, and to be grasped in a hand of the user to assist the user in sitting and rising.

12 Claims, 5 Drawing Sheets

BATHTUB INSERT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to insert assemblies and more particularly pertains to a new insert assembly for facilitating safe bathing.

BRIEF SUMMARY OF THE INVENTION

An embodiment of the disclosure meets the needs presented above by generally comprising a shell, which has a top that is open. A lower section of the shell is substantially complementary to a width of a bathtub. An interior surface of the shell is resilient and is configured to absorb an impact imparted by a user to prevent injury. A first plate and a second plate are coupled to a first end and a second end of the shell, respectively. The first plate is configured to seat the user. The second plate is configured to support the user's feet. A pair of armrests is coupled to the shell between the first plate and the top of the shell. At least one rail is coupled to the interior surface and is configured to position items, such as soap, and to be grasped in a hand of the user to assist the user in sitting and rising.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
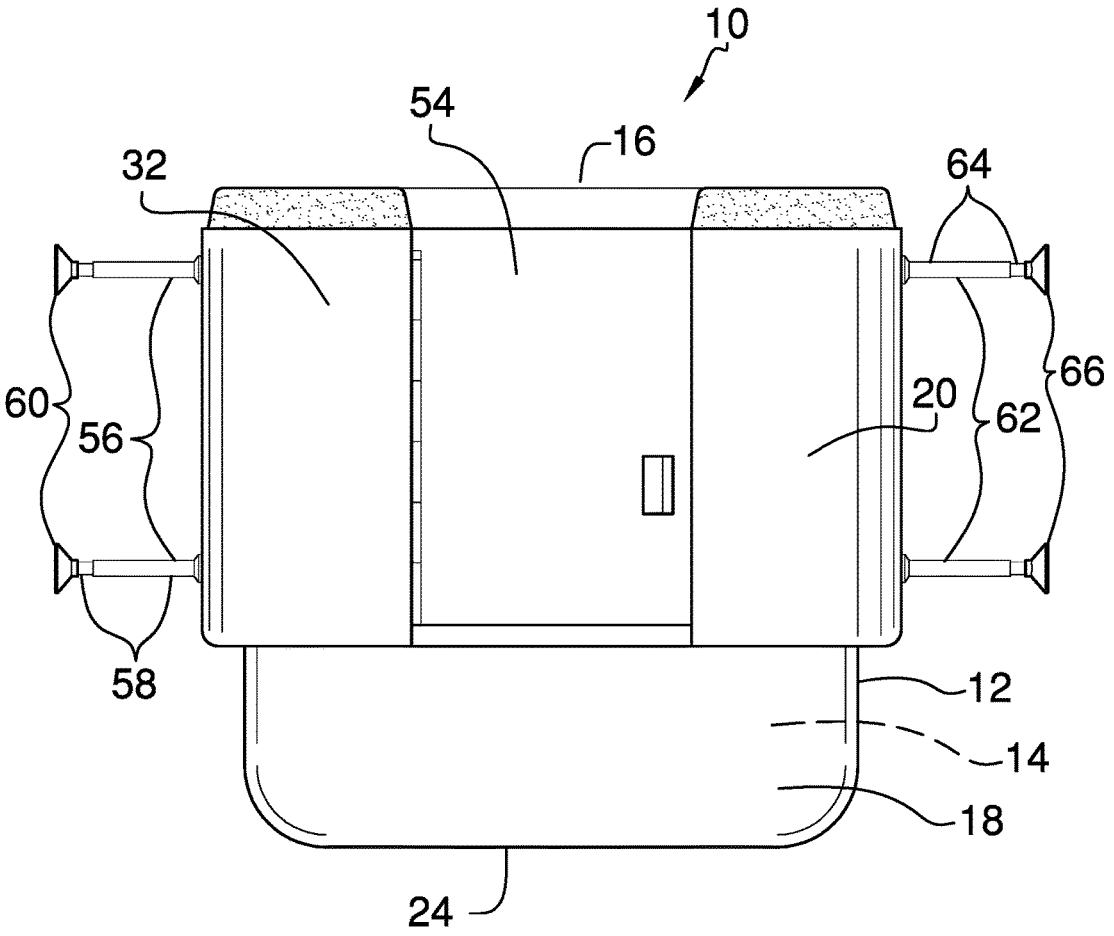
FIG. 1 is a front view of a bathtub insert assembly according to an embodiment of the disclosure.
Figure 2:
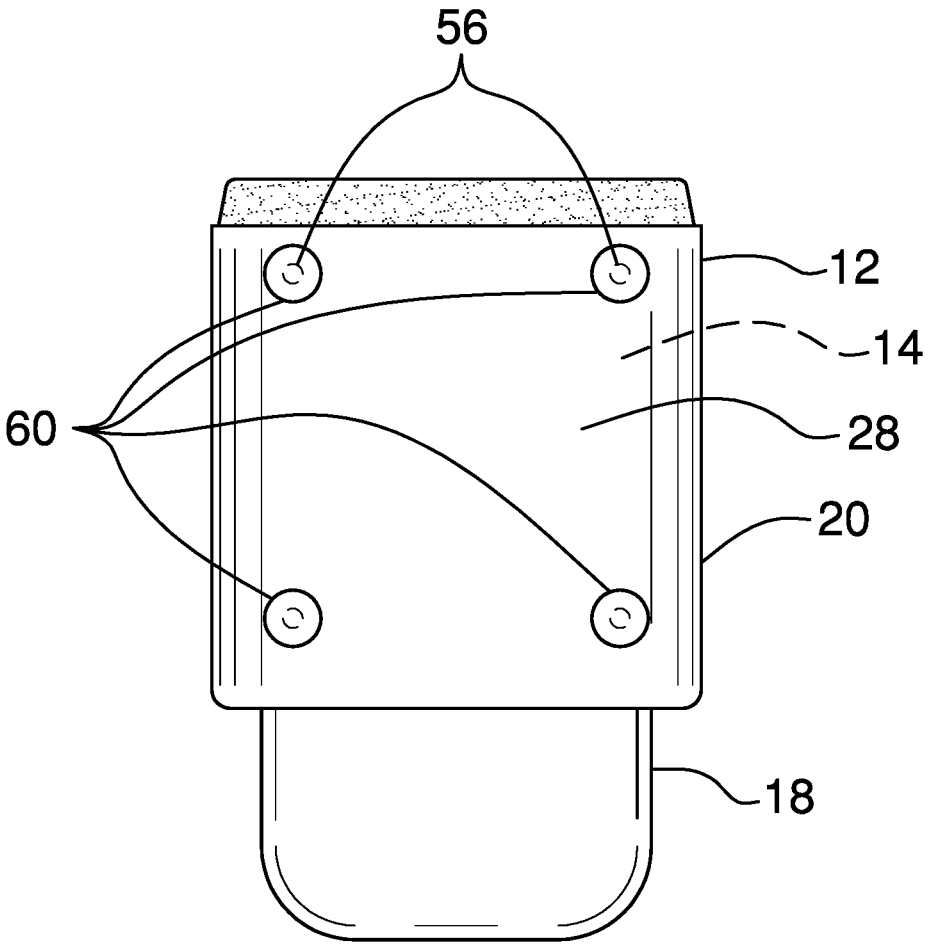
FIG. 2 is an end view of an embodiment of the disclosure.
Figure 3:
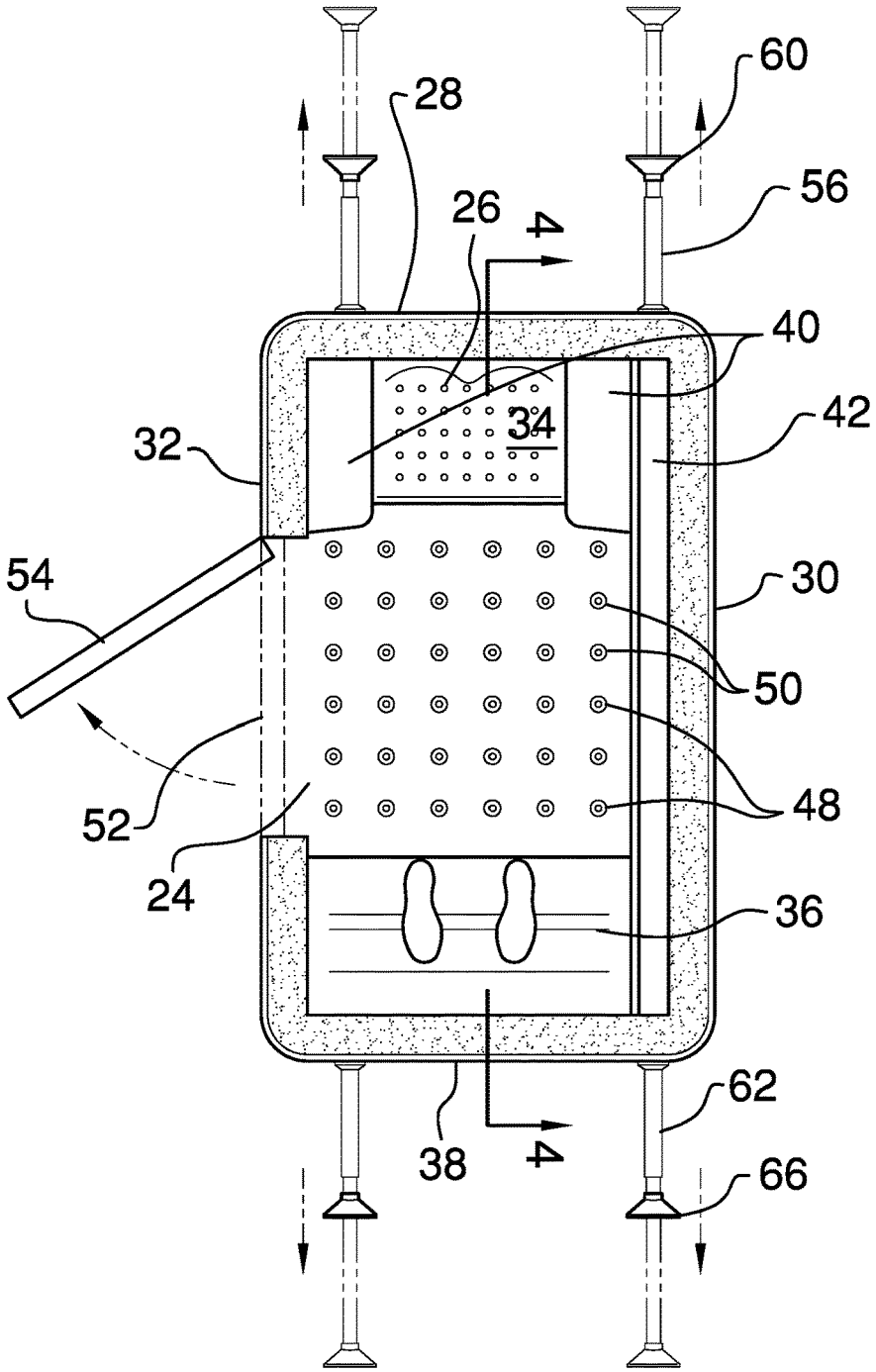
FIG. 3 is a top view of an embodiment of the disclosure.
Figure 4:
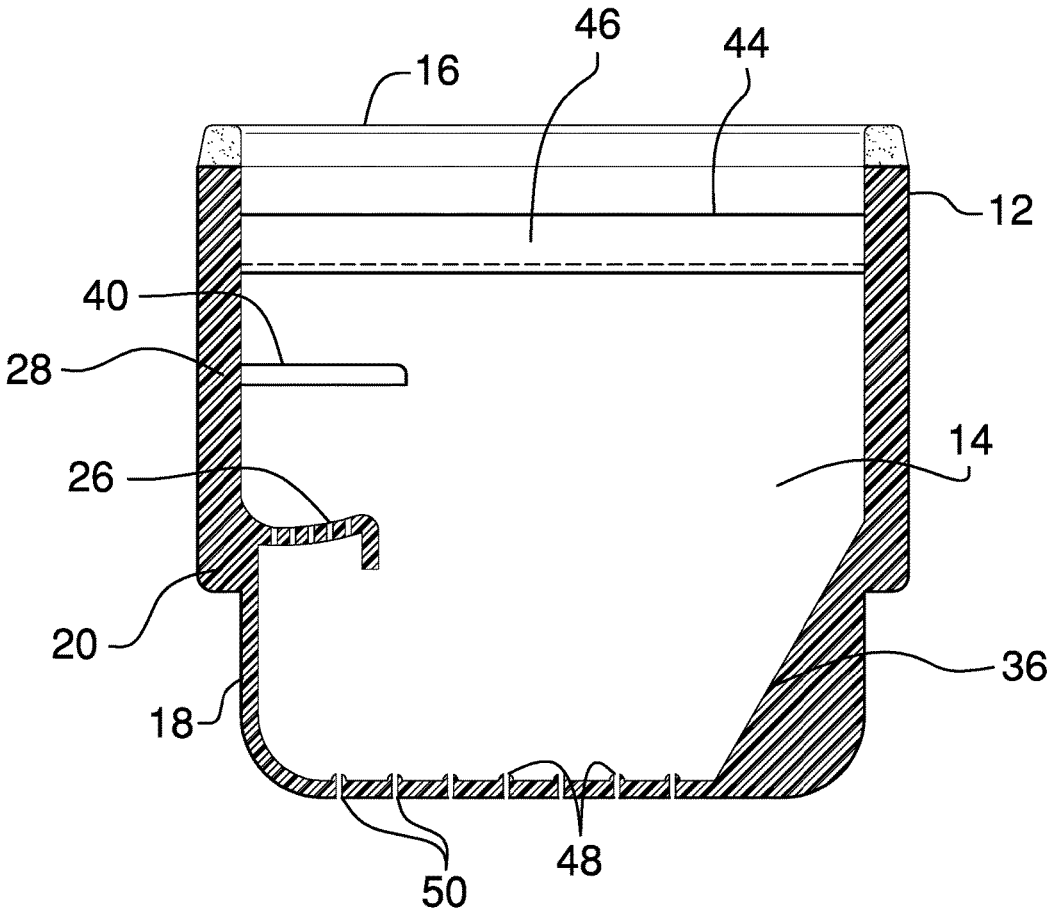
FIG. 4 is a cross-sectional view of an embodiment of the disclosure.
Figure 5:
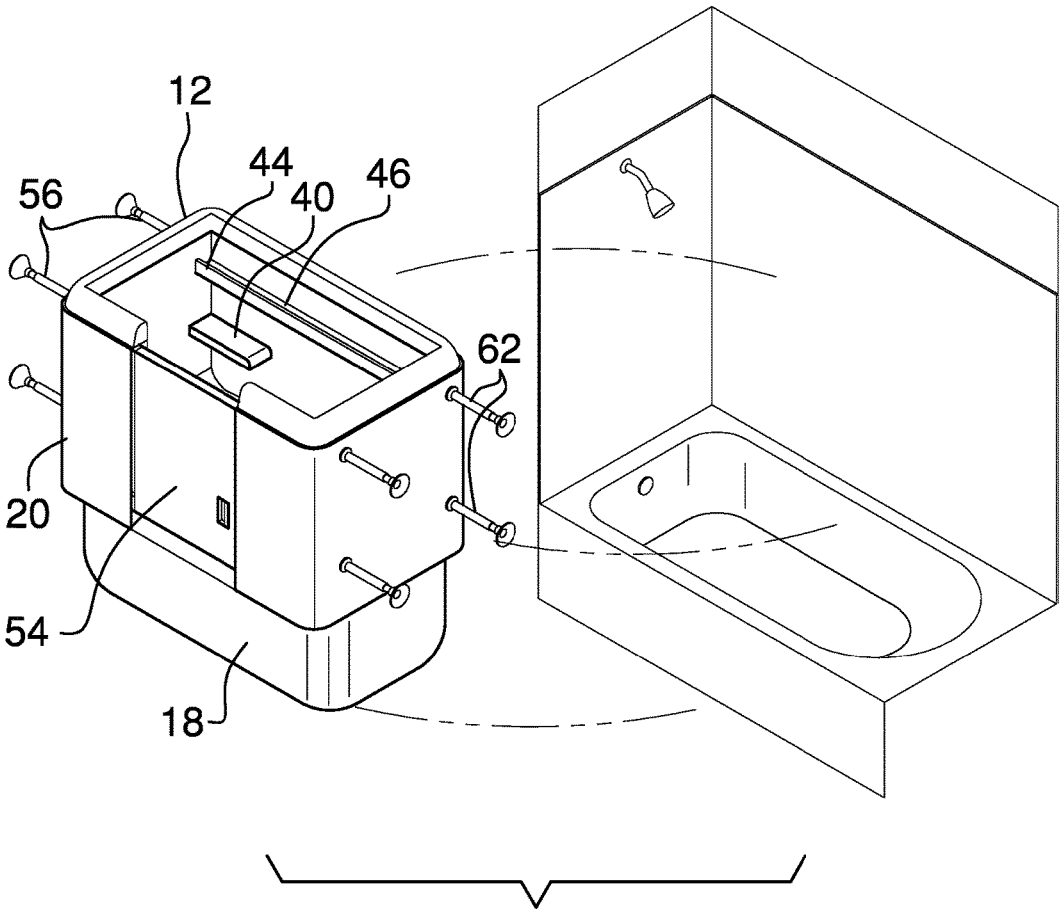
FIG. 5 is an isometric perspective view of an embodiment of the disclosure.

With reference now to the drawings, and in particular to FIGS. 1 through 5 thereof, a new insert assembly embodying the principles and concepts of an embodiment of the disclosure and generally designated by the reference numeral 10 will be described.

As best illustrated in FIGS. 1 through 5, the bathtub insert assembly 10 generally comprises a shell 12 that defines an interior space 14. The shell 12 has a top 16 that is open. The top 16 is configured to add water to the interior space 14. The shell 12 has a lower section 18 that is substantially complementary to a width of a bathtub. The shell 12 has an upper section 20 that is coupled to and extends from the lower section 18. The shell 12 has an interior surface 22 that is resilient. The interior surface 22 is configured to absorb an impact imparted by a user who falls within the interior space 14 to prevent injury to the user. In one embodiment, the interior surface 22 comprises rubber. In another embodiment, the lower section 18 is arcuate proximate to a bottom 24 of the shell 12. The lower section 18 is substantially complementary to a lower surface of the bathtub.

A first plate 26 is coupled to a first end 28 of the shell 12 and extends into the interior space 14. The first plate 26 is configured to seat the user. In one embodiment, the first plate 26 extends between a first side 30 and a second side 32 of the shell 12. In another embodiment, the first plate 26 is arcuate. The first plate 26 has an upper surface 34. In yet another embodiment, the upper surface 34 is textured. The first plate 26 is configured to deter slippage of the user upon the upper surface 34.

A second plate 36 is coupled to a second end 38 of the shell 12 and extends into the interior space 14. The second plate 36 is configured to support feet of the user. In one embodiment, the second plate 36 extends transversely between the second end 38 and the bottom 24 of the shell 12.

A pair of armrests 40 is coupled singly to the first side 30 and the second side 32 of the shell 12 between the first plate 26 and the top 16 of the shell 12. Each armrest 40 is configured to support a respective arm of the user.

At least one rail 42 is coupled to and extends from the interior surface 22. The at least one rail 42 is configured to position items, such as soap. The at least one rail 42 also is configured to be grasped in a hand of the user to assist the user in sitting upon and rising from the first plate 26. In one embodiment, the at least one rail 42 comprises a bar 44 that is coupled to the first side 30 of the shell 12. The bar 44 extends between the first end 28 and the second end 38 of the shell 12. The bar 44 is L-shaped and defines a channel 46. The channel 46 is configured to position the items, such as the soap. The bar 44 is configured to be grasped in the hand of the user to assist the user in sitting upon and rising from the first plate 26.

A plurality of protrusions 48 is coupled to and extends from the bottom 24 of the shell 12 into the interior space 14. The protrusions 48 are configured to deter slippage of the feet of the user upon the bottom 24 of the shell 12. In one embodiment, the protrusions 48 are circularly shaped when viewed from the top 16 of the shell 12.

Each of a plurality of holes 50 is centrally positioned through a respective protrusion 48 and extends through the bottom 24 of the shell 12. The holes 50 are configured to drain water from the interior space 14.

An opening 52 is positioned in the second side 32 of the shell 12. The opening 52 is positioned in the upper section 20 substantially equally distant from the first end 28 and the second end 38 of the shell 12. The opening 52 is configured to allow entry and exit of the user from the interior space 14.

A panel 54 is hingedly coupled to the shell 12 adjacent to the opening 52. The panel 54 is complementary to the opening 52. The panel 54 is reversibly sealably couplable to the shell 12 to selectively close the opening 52.

A plurality of first rods 56 is coupled to and extends perpendicularly from the first end 28 of the shell 12. Each first rod 56 comprises a plurality of first nested sections 58 so that the first rod 56 is selectively extensible. The first rods 56 are configured to be extended between the shell 12 and a first sidewall of an enclosure in which the bathtub is positioned.

Each of a plurality of first cups 60 is coupled to a respective first rod 56 distal from the shell 12. The first cups 60 are resilient and are configured to suctionally couple to the first sidewall of the enclosure.

A plurality of second rods 62 is coupled to and extends perpendicularly from the second end 38 of the shell 12. Each second rod 62 comprises a plurality of second nested sections 64 so that the second rod 62 is selectively extensible. The second rods 62 are configured to be extended between the shell 12 and a second sidewall of the enclosure. In one embodiment, the plurality of first rods 56 comprises four first rods 56 and the plurality of second rods 62 comprises four second rods 62.

Each of a plurality of second cups 66 is coupled to a respective second rod 62 distal from the shell 12. The second cups 66 are resilient and are configured to suctionally couple to the second sidewall of the enclosure.

In use, the first rods 56 are configured to be extended between the shell 12 and the first sidewall of the enclosure in which the bathtub is positioned. The first cups 60 are configured to suctionally couple to the first sidewall. The second rods 62 are configured to be extended between the shell 12 and the second sidewall of the enclosure. The second cups 66 are configured to suctionally couple to the second sidewall. The opening 52 is configured to allow entry and exit of the user from the interior space 14. The panel 54 is positioned to selectively close the opening 52. The first plate 26 is configured to seat the user. The upper surface 34 of the first plate 26 is textured to deter slippage of the user upon the upper surface 34. The second plate 36 is configured to support the feet of the user. Each armrest 40 is configured to support the respective arm of the user. The channel 46 is configured to position the items, such as the soap. The bar 44 is configured to be grasped in the hand of the user to assist the user in sitting upon and rising from the first plate 26. The protrusions 48 are configured to deter slippage of the feet of the user upon the bottom 24 of the shell 12. The holes 50 are configured to drain the water from the interior space 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bathtub insert assembly comprising:

a shell defining an interior space, said shell having a top, said top being open such that said top is configured for adding water to said interior space, said shell having a lower section substantially complementary to a width of a bathtub, said shell having an upper section coupled to and extending from said lower section, said shell having an interior surface, said interior surface being resilient such that said interior surface is configured for absorbing an impact imparted by a user falling within said interior space for preventing injury to the user;

a first plate coupled to a first end of said shell and extending into said interior space;

a second plate coupled to a second end of said shell and extending into said interior space;

a pair of armrests, said armrests being coupled singly to a first side and a second side of said shell between said first plate and said top of said shell;

at least one rail coupled to and extending from said interior surface;

wherein said first plate is positioned on said shell such that said first plate is configured for seating the user, wherein said second plate is positioned on said shell such that said second plate is configured for supporting feet of the user, wherein said armrests are positioned on said shell such that each said armrest is configured for supporting a respective arm of the user, wherein said at least one rail is positioned on said shell such that said at least one rail is configured for positioning items and for grasping in a hand of the user for assisting the user in sitting upon and rising from said first plate;

a plurality of first rods coupled to and extending perpendicularly from said first end of said shell, each said first rod comprising a plurality of first nested sections such that said first rod is selectively extensible;

a plurality of first cups, said first cups being resilient, each said first cup being coupled to a respective said first rod distal from said shell;

a plurality of second rods coupled to and extending perpendicularly from said second end of said shell, each said second rod comprising a plurality of second nested sections such that said second rod is selectively extensible;

a plurality of second cups, said second cups being resilient, each said second cup being coupled to a respective said second rod distal from said shell; and wherein said first rods are positioned on said shell such that said first rods are configured for extending between said shell and a first sidewall of an enclosure in which the bathtub is positioned, wherein said first cups are positioned on said first rods such that said first cups are configured for suctionally coupling to the first sidewall of the enclosure, wherein said second rods are positioned on said shell such that said second rods are configured for extending between said shell and a second sidewall of the enclosure, wherein said second cups are positioned on said second rods such that said second cups are configured for suctionally coupling to the second sidewall of the enclosure.

2. The assembly of claim 1, further including said interior surface comprising rubber.

3. The assembly of claim 1, further including said lower section being arcuate proximate to a bottom of said shell such that said lower section is substantially complementary to a lower surface of the bathtub.

4. The assembly of claim 1, further including said first plate extending between said first side and said second side of said shell.

5. The assembly of claim 1, further including said first plate being arcuate, said first plate having an upper surface, said upper surface being textured such that said first plate is configured for deterring slipping of the user upon said upper surface.

6. The assembly of claim 1, further including said second plate extending transversely between said second end and a bottom of said shell.

7. The assembly of claim 1, further including said at least one rail comprising a bar coupled to said first side of said shell and extending between said first end and said second end of said shell, said bar being L-shaped defining a channel, wherein said bar is positioned on said shell such that said channel is configured for positioning the items and wherein said bar is configured for grasping in the hand of the user for assisting the user in sitting upon and rising from said first plate.

8. The assembly of claim 1, further comprising:

a plurality of protrusions coupled to and extending from said bottom of said shell into said interior space;

a plurality of holes, each said hole being centrally positioned through a respective said protrusion and extending through said bottom of said shell; and wherein said protrusions are positioned on said shell such that said protrusions are configured for deterring slipping of the feet of the user upon said bottom of said shell, wherein said holes are positioned in said bottom such that said holes are configured for draining the water from said interior space.

9. The assembly of claim 8, further including said protrusions being circularly shaped when viewed from said top of said shell.

10. The assembly of claim 1, further comprising:

an opening positioned in said second side of said shell, said opening being positioned in said upper section substantially equally distant from said first end and said second end of said shell;

a panel hingedly coupled to said shell adjacent to said opening, said panel being complementary to said opening, said panel being reversibly sealably couplable to said shell for selectively closing said opening; and wherein said opening is positioned in said shell such that said opening is configured for entering and exiting of the user from said interior space, wherein said panel is positioned on said shell such that said panel is positioned for selectively closing said opening.

11. The assembly of claim 1, further comprising:

said plurality of first rods comprising four said first rods; and said plurality of second rods comprising four said second rods.

12. A bathtub insert assembly comprising:

a shell defining an interior space, said shell having a top, said top being open such that said top is configured for adding water to said interior space, said shell having a lower section substantially complementary to a width of a bathtub, said shell having an upper section coupled to and extending from said lower section, said shell having an interior surface, said interior surface being resilient such that said interior surface is configured for absorbing an impact imparted by a user falling within said interior space for preventing injury to the user, said interior surface comprising rubber, said lower section being arcuate proximate to a bottom of said shell such that said lower section is substantially complementary to a lower surface of the bathtub;

a first plate coupled to a first end of said shell and extending into said interior space, wherein said first plate is positioned on said shell such that said first plate is configured for seating the user, said first plate extending between a first side and a second side of said shell, said first plate being arcuate, said first plate having an upper surface, said upper surface being textured such that said first plate is configured for deterring slipping of the user upon said upper surface;

a second plate coupled to a second end of said shell and extending into said interior space, wherein said second plate is positioned on said shell such that said second plate is configured for supporting feet of the user, said second plate extending transversely between said second end and said bottom of said shell;

a pair of armrests, said armrests being coupled singly to said first side and said second side of said shell between said first plate and said top of said shell, wherein said armrests are positioned on said shell such that each said armrest is configured for supporting a respective arm of the user;

at least one rail coupled to and extending from said interior surface, wherein said at least one rail is positioned on said shell such that said at least one rail is configured for positioning items and for grasping in a hand of the user for assisting the user in sitting upon and rising from said first plate, said at least one rail comprising a bar coupled to said first side of said shell and extending between said first end and said second end of said shell, said bar being L-shaped defining a channel, wherein said bar is positioned on said shell such that said channel is configured for positioning the items and wherein said bar is configured for grasping in the hand of the user for assisting the user in sitting upon and rising from said first plate;

a plurality of protrusions coupled to and extending from said bottom of said shell into said interior space, wherein said protrusions are positioned on said shell such that said protrusions are configured for deterring slipping of the feet of the user upon said bottom of said shell, said protrusions being circularly shaped when viewed from said top of said shell;

a plurality of holes, each said hole being centrally positioned through a respective said protrusion and extending through said bottom of said shell, wherein said holes are positioned in said bottom such that said holes are configured for draining water from said interior space;

an opening positioned in said second side of said shell, said opening being positioned in said upper section substantially equally distant from said first end and said second end of said shell, wherein said opening is positioned in said shell such that said opening is configured for entering and exiting of the user from said interior space;

a panel hingedly coupled to said shell adjacent to said opening, said panel being complementary to said opening, said panel being reversibly sealably couplable to said shell for selectively closing said opening, wherein said panel is positioned on said shell such that said panel is positioned for selectively closing said opening;

a plurality of first rods coupled to and extending perpendicularly from said first end of said shell, each said first rod comprising a plurality of first nested sections such that said first rod is selectively extensible, wherein said first rods are positioned on said shell such that said first rods are configured for extending between said shell and a first sidewall of an enclosure in which the bathtub is positioned, said plurality of first rods comprising four said first rods;

a plurality of first cups, said first cups being resilient, each said first cup being coupled to a respective said first rod distal from said shell, wherein said first cups are positioned on said first rods such that said first cups are configured for suctionally coupling to the first sidewall of the enclosure;

a plurality of second rods coupled to and extending perpendicularly from said second end of said shell, each said second rod comprising a plurality of second nested sections such that said second rod is selectively extensible, wherein said second rods are positioned on said shell such that said second rods are configured for extending between said shell and a second sidewall of the enclosure, said plurality of second rods comprising four said second rods;

a plurality of second cups, said second cups being resilient, each said second cup being coupled to a respective said second rod distal from said shell, wherein said second cups are positioned on said second rods such that said second cups are configured for suctionally coupling to the second sidewall of the enclosure; and wherein said first rods are positioned on said shell such that said first rods are configured for extending between said shell and the first sidewall of the enclosure in which the bathtub is positioned, wherein said first cups are positioned on said first rods such that said first cups are configured for suctionally coupling to the first sidewall, wherein said second rods are positioned on said shell such that said second rods are configured for extending between said shell and the second sidewall of the enclosure, wherein said second cups are positioned on said second rods such that said second cups are configured for suctionally coupling to the second sidewall, wherein said opening is positioned in said shell such that said opening is configured for entering and exiting of the user from said interior space, wherein said panel is positioned on said shell such that said panel is positioned for selectively closing said opening, wherein said first plate is positioned on said shell such that said first plate is configured for seating the user, wherein said upper surface of said first plate is textured such that said first plate is configured for deterring slipping of the user upon said upper surface, wherein said second plate is positioned on said shell such that said second plate is configured for supporting the feet of the user, wherein said armrests are positioned on said shell such that each said armrest is configured for supporting the respective arm of the user, wherein said bar is positioned on said shell such that said channel is configured for positioning the items and wherein said bar is configured for grasping in the hand of the user for assisting the user in sitting upon and rising from said first plate, wherein said protrusions are positioned on said shell such that said protrusions are configured for deterring slipping of the feet of the user upon said bottom of said shell, wherein said holes are positioned in said bottom such that said holes are configured for draining the water from said interior space.

* * * * *